US006749006B1

(12) United States Patent
Yang et al.

(10) Patent No.: US 6,749,006 B1
(45) Date of Patent: Jun. 15, 2004

(54) METHOD OF MAKING INVESTMENT CASTING MOLDS

(75) Inventors: Xi Yang, Muskegon, MI (US); Ronald James Keller, Grand Haven, MI (US)

(73) Assignee: Howmet Research Corporation, Whitehall, MI (US)

( * ) Notice: Subject to any disclaimer, the term of this patent is extended or adjusted under 35 U.S.C. 154(b) by 0 days.

(21) Appl. No.: 09/690,144

(22) Filed: Oct. 16, 2000

(51) Int. Cl.[7] ..... B22C 9/00; B22C 9/02
(52) U.S. Cl. ..... 164/516; 164/34; 164/361
(58) Field of Search ..... 164/516, 34, 35, 164/44, 45, 235, 361

(56) References Cited

U.S. PATENT DOCUMENTS

| | | | | |
|---|---|---|---|---|
| 2,932,864 A | | 4/1960 | Mellen, Jr. et al. | 22/196 |
| 3,747,663 A | | 7/1973 | Taylor | 164/25 |
| 3,755,915 A | * | 9/1973 | Nagell | 34/95 |
| 3,856,459 A | | 12/1974 | Bourton | 432/58 |
| 4,084,521 A | | 4/1978 | Herbold et al. | 110/242 |
| 4,114,285 A | | 9/1978 | Cruff et al. | 34/29 |
| 4,268,975 A | | 5/1981 | Schall et al. | 34/105 |
| 4,440,806 A | | 4/1984 | Muri | 427/180 |
| 4,664,172 A | | 5/1987 | Takayanagi | 164/34 |
| 4,682,643 A | | 7/1987 | Bernhardt et al. | 164/34 |
| 4,690,201 A | | 9/1987 | VanRens | 164/516 |
| 4,695,186 A | | 9/1987 | King | 404/111 |
| 4,728,531 A | * | 3/1988 | Matz et al. | 427/45.1 |
| 4,854,368 A | | 8/1989 | Vezirian | 164/34 |
| 4,921,038 A | | 5/1990 | Sasaki et al. | 164/516 |
| 4,995,443 A | | 2/1991 | Easwaran | 164/34 |
| 5,022,920 A | * | 6/1991 | Buntrock et al. | 106/38.3 |
| 5,088,544 A | | 2/1992 | Garat | 164/34 |
| 5,203,398 A | | 4/1993 | Easwaran | 164/516 |
| 5,290,373 A | | 3/1994 | Donahue et al. | 148/549 |
| 5,327,955 A | | 7/1994 | Easwaran | 164/516 |
| 5,523,537 A | | 6/1996 | Johannes et al. | 219/421 |
| 5,629,369 A | * | 5/1997 | Guerra, Jr. | 524/493 |
| 5,650,083 A | | 7/1997 | Bondeson et al. | 219/421 |
| 5,683,241 A | | 11/1997 | Casselman | 432/97 |
| 5,738,819 A | | 4/1998 | Feagin | 264/635 |
| 5,775,542 A | | 7/1998 | Field | 222/146.5 |
| 5,824,730 A | * | 10/1998 | Guerra, Jr. | 524/493 |
| 5,975,188 A | | 11/1999 | Lassow et al. | 164/76.1 |
| 6,056,157 A | | 5/2000 | Gehl et al. | 222/94 |

FOREIGN PATENT DOCUMENTS

| | | |
|---|---|---|
| DE | 3534748 | 4/1987 |
| EP | 0153432 | 9/1985 |
| EP | 0280091 | 8/1988 |
| GB | 845756 | 8/1960 |
| GB | 862209 | 3/1961 |
| GB | 2004042 | 3/1979 |
| GB | 1577233 | 10/1980 |
| JP | 63242439 | 7/1988 |
| JP | 7258755 | 10/1995 |
| RU | 624931 | 8/1978 |
| WO | WO 98/32557 | 7/1998 |

* cited by examiner

*Primary Examiner*—M. Alexandra Elve
(74) *Attorney, Agent, or Firm*—Edward J. Timmer; Gary P. Topolosky

(57) ABSTRACT

A method of forming a ceramic investment shell mold about a fugitive wax pattern of an article comprises coating the pattern with ceramic slurry, applying a ceramic particulate material heated above ambient temperature to the slurry layer, drying the ceramic slurry layer with ceramic particulates thereon, and repeating said coating, applying and drying steps to build up a shell mold on the pattern. The ceramic slurry with ceramic particulates thereon is dried initially dried for a time using relatively low humidity flowing air at an air temperature above about 80 degrees F. and then subsequently for a time using relatively low humidity flowing air at an air temperature not exceeding about 80 degrees F. Ceramic investment shell molds can be built-up in times typically less than 10 hours by practice of the invention with substantially reduced incidence of shell mold cracking during the shell mold building process and subsequent pattern removal operation.

10 Claims, 4 Drawing Sheets

METHOD OF MAKING INVESTMENT CASTING MOLDS

FIELD OF THE INVENTION

The present invention relates to ceramic investment shell molds and their manufacture for casting metals and alloys.

BACKGROUND OF THE INVENTION

In casting superalloy gas turbine engine blades and vanes using conventional equiaxed and directional solidification techniques, ceramic investment shell molds with or without a ceramic core therein are filled with molten metal or alloy that is solidified in the mold. The ceramic shell mold is made by the well known lost-wax process where a fugitive (e.g. wax) pattern of the blade, vane or other article to be cast is repeatedly dipped in a ceramic slurry, drained of excess slurry and then stuccoed with ceramic particulates, such as ceramic sand (stucco) to build up the shell mold wall thickness to a desired value. The pattern then is selectively removed from the shell mold by thermal or chemical dewaxing techniques, and the green mold is fired to develop adequate mold strength for casting. U.S. Pat. Nos. 5,335,717 and 5,975,188 describe a typical lost-process sequence to make ceramic investment casting shell molds.

Current lost-wax mold-making processes employ water-based ceramic slurries and low temperature wax patterns. Production of a ceramic shell mold around such a pattern typically takes more than forty hours.

Pattern materials such as wax usually are used in the lost-wax process at pattern temperatures less than about 78 degrees F. because the wax pattern melts or softens at sustained wax temperatures above 80 degrees F., resulting in pattern distortion. Moreover, when the pattern is coated with a layer of water based ceramic slurry, the temperature of the pattern drops as it provides heat of evaporation. This temperature decrease not only reduces the subsequent drying rate of the ceramic slurry, but also results in pattern contraction during cooling and subsequent expansion when the wax pattern warms up again, the latter unfortunately coinciding with the slurry layer drying and becoming more rigid. Shell mold cracks can be initiated by the thermal expansion mismatch between the relatively high expansion wax pattern and relatively low expansion shell layer when the wax temperature returns back to ambient temperature before the next dipping/stuccoing step of the lost-wax process.

High temperature, low humidity drying air (e.g. 1–10% relative humidity air) and high speed flowing drying air conditions frequently are used in the lost-wax process after each dipping/stuccoing step to speed shell mold manufacture and can result in larger temperature drops in a first few minutes after dipping the pattern in the slurry. Cracking of the slurry layers can occur during the shell mold building process and also during the pattern removal operation as a result of thermal expansion mismatch of the pattern and the shell. U.S. Pat. No. 4,114,285 describes drying conditions to make ceramic shell molds to speed and improve the mold production process.

An object of the present invention is to substantially reduce the processing time to make a ceramic shell mold.

Another object of the present invention is to substantially reduce shell mold cracking during the mold building steps and pattern removal operation.

SUMMARY OF THE INVENTION

An embodiment of the present invention provides a method of making a ceramic investment shell mold wherein ceramic particulates, such as for example sand or stucco, heated to superambient temperature are applied to at least some ceramic slurry layers on the pattern to reduce pattern temperature fluctuations during the mold building process.

In a particular embodiment of the present invention, at least some ceramic slurry and heated stucco layers applied on the pattern are initially dried for a time in relatively low humidity flowing air at an air temperature above a pattern thermal degradation temperature (e.g. at a temperature about 80–95 degrees F. for a wax pattern) and then subsequently dried for a time in relatively low humidity flowing air at an air temperature below the degradation temperature (e.g. not exceeding about 78–80 degrees F. for a wax pattern).

Ceramic investment shell molds can be built-up in times typically less than 10 to 20 hours depending on cast component, and thus on mold complexity, by practice of the invention with substantially reduced incidence of shell mold cracking during the shell mold building process and subsequent pattern removal operation.

The above objects and advantages of the present invention will become more readily apparent from the following detailed description taken with the following drawings.

DETAILED DESCRIPTION OF THE DRAWINGS

DETAILED DESCRIPTION OF THE INVENTION

The invention provides a method of forming a ceramic investment shell mold about a fugitive pattern of an article to be cast of metal or alloy in a manner to substantially reduce the processing time to make a ceramic shell mold and to substantially reduce shell mold cracking during the lost-wax processing steps and pattern removal operation.

An illustrative embodiment of the present invention involves coating a fugitive pattern with a water based ceramic slurry, applying ceramic particulates (e.g. ceramic sand or stucco particles) heated above ambient temperature to the slurry layer, draining excess slurry from the pattern, drying the ceramic slurry layer with ceramic particulates thereon initially for a time using relatively low humidity flowing air at an air temperature above a thermal degradation temperature of the pattern which is a temperature where the pattern begins to melt, soften or distort from its blueprint or engineering dimensional tolerances (e.g. above about 78 degrees F. for a wax pattern) and then subsequently for a time using relatively low humidity flowing air at an air temperature below the thermal degradation temperature (e.g. not exceeding about 78–80 degrees F. for a wax pattern), and repeating said coating, draining, applying and drying steps to build up a shell mold of desired thickness on the pattern.

In practicing the invention, the fugitive pattern typically comprises a conventional wax pattern material that melts or softens at about 78 degrees F., more generally in the range of 75 to 85 degrees F. The wax pattern is conventionally injection molded or otherwise formed to a desired shape of the article to be cast of metal or alloy. The invention is not limited to a wax pattern material and can be practiced using other fugitive pattern materials such as ultraviolet curing SLA (sterolithography) resins, polystyrene, and other polymeric materials.

The ceramic slurries typically comprise water based slurries at a temperature below about 78 degrees F., preferably 72 to 75 degrees F. plus or minus 1 degrees F. for a wax pattern. A facecoat ceramic slurry is applied to the pattern first by dipping the pattern in the ceramic facecoat slurry held in a pot P1 at a dip station S1, FIG. 1. The composition of the facecoat slurry is selected in dependence on the cast component specifications and metal or alloy to be cast in the shell mold. Excess facecoat slurry is gravity drained from the pattern in the conventional manner over dip pot S1, FIG. 1, and then fine ceramic sand or stucco particles are applied to the wet ceramic facecoat slurry layer on the pattern in the conventional manner at a stucco station S3, FIG. 1; e.g. by gravity rainfall of the ceramic sand or stucco from a hopper above the wet slurry coated pattern.

Figure 1:
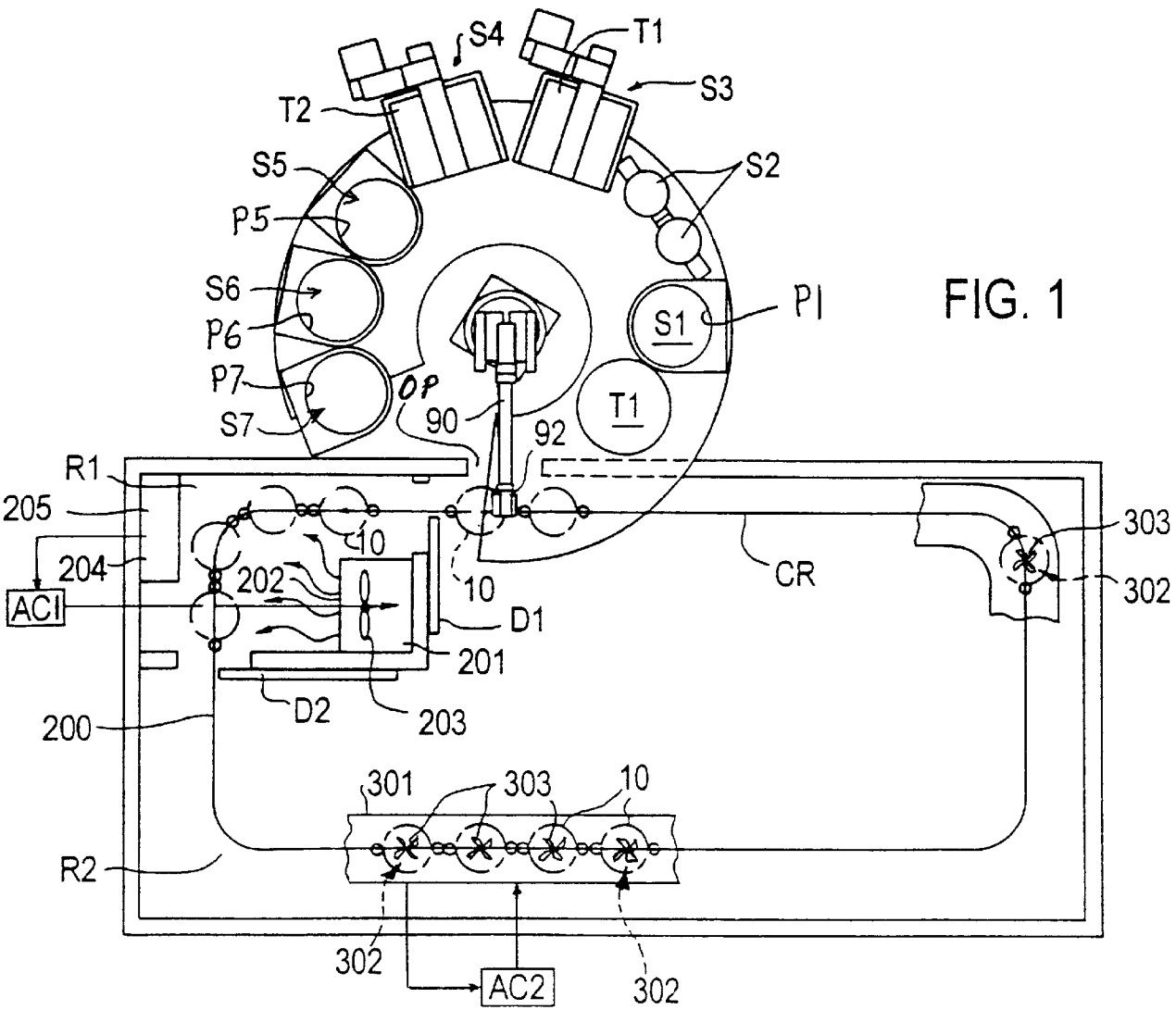
FIG. 1 is a schematic diagram of slurry dipping stations, stucco tower stations and drying air rooms for use practice of the invention.
Figure 1B:
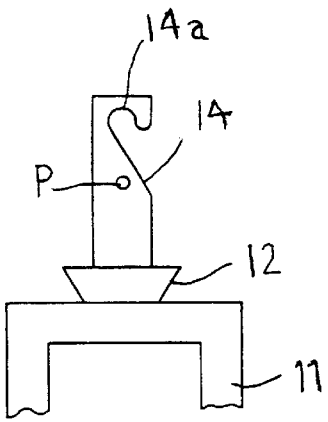
FIG. 1B is a schematic elevation of a mold handle.
Figure 1A:
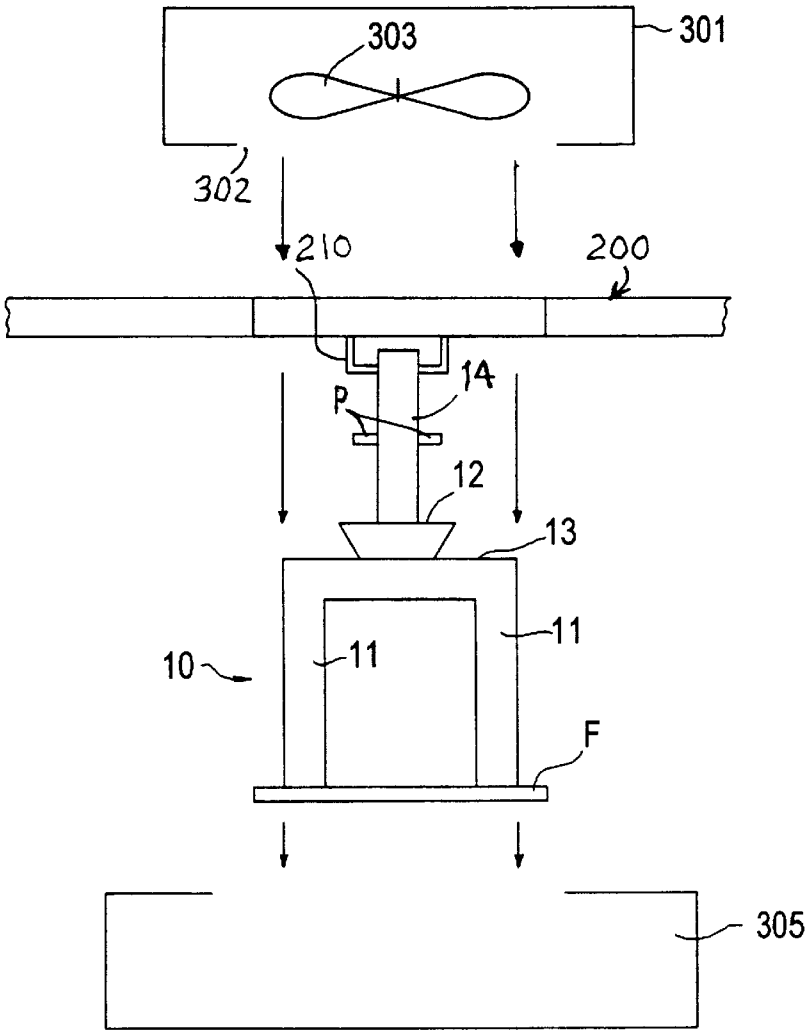
FIG. 1A is a schematic elevational view of a conventional wax pattern assembly on a fixture positioned at a drying outlet of a drying room.
Figure 2:
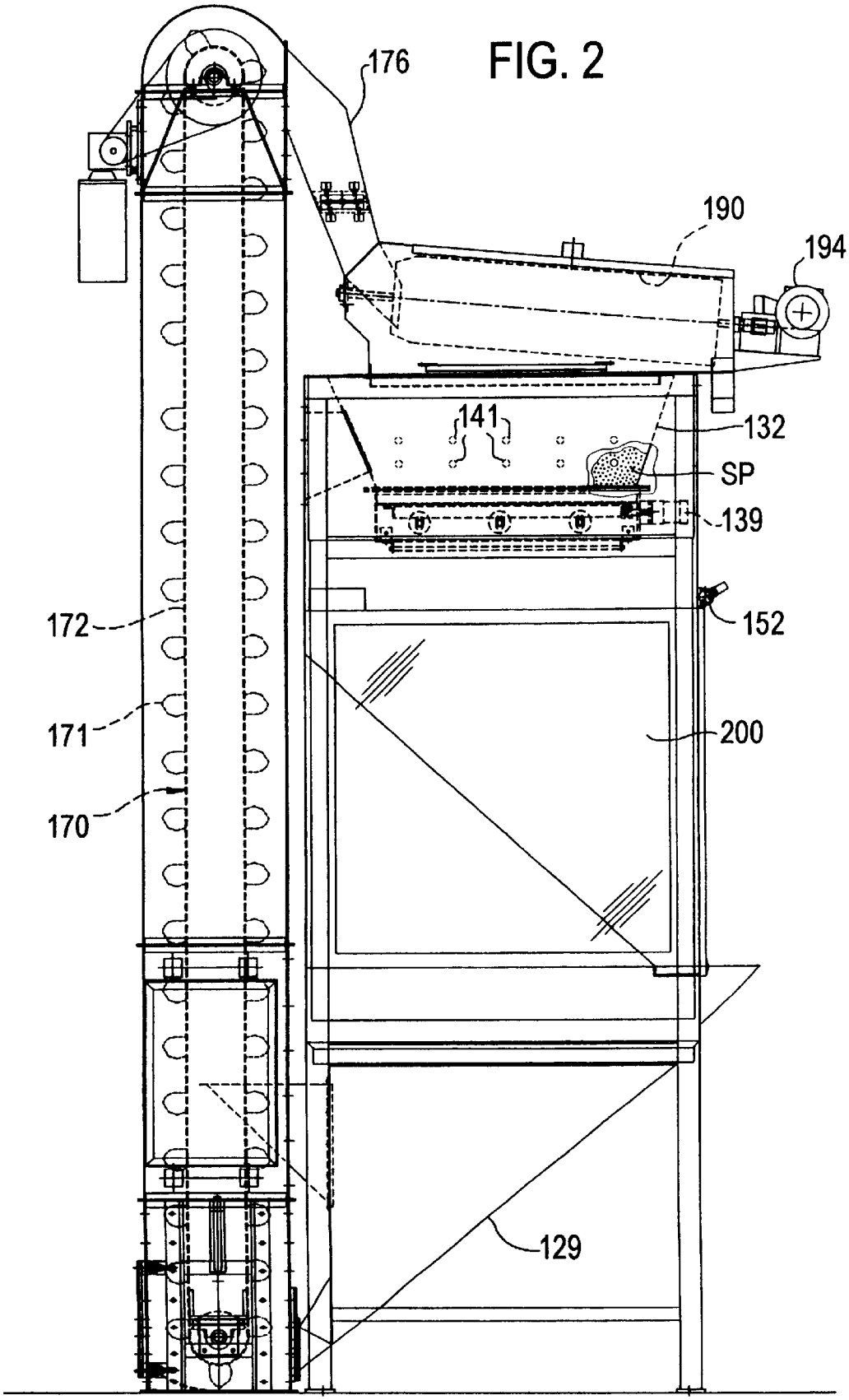
FIG. 2 is a side elevational view of a stucco tower for practicing the invention.

In practicing an illustrative embodiment of the invention, a conventional wax pattern assembly 10 is made by wax welding together multiple wax patterns 11 of the components to be cast, a wax pour cup 12, wax runners 13 and optional other wax mold elements, FIG. 1A. If the ceramic investment shell mold to be formed is to be used in directional solidification processes, the wax pattern assembly 10 may be positioned on a fixture plate F in conventional manner. If the ceramic shell mold to be formed is to be used in equiaxed solidification processes, the fixture plate F can be omitted. A rotatable robotic arm 90 grips pin P on a mold handle 14 that is attached to wax pour cup 12 and dips the pattern assembly 10 in the ceramic slurry at the slurry pot at station S1, raises the pattern assembly out of the ceramic slurry to drain excess ceramic slurry from the pattern assembly, and then moves the ceramic slurry coated pattern assembly to station S3 where the robotic arm 90 orients the pattern assembly with its longitudinal axis generally horizontal and places the pattern assembly in the stucco tower T1 where a wrist 92 on the robotic arm 90 rotates the pattern assembly about the longitudinal axis as stucco or sand at superambient temperature is rained down by gravity thereon. Stations S2 in FIG. 1 are input stations where fresh wax pattern assemblies are presented properly oriented for pickup by the robotic arm.

The stucco tower at station S3 is of the type described in detail in copending U.S. patent application Ser. No. 09/626,496 entitled STUCCO TOWER AND METHOD filed Jul. 27, 2000, of common assignee herewith, the teachings of which are incorporated herein by reference. The stucco tower includes an internal chamber 112 in which the wet ceramic slurry coated pattern assembly 10 is positioned generally horizontally and rotated by robotic arm 90 to expose exterior surfaces of the pattern assembly to loose, dry ceramic stucco particles SP released from a hopper 132 atop the stucco tower to fall downwardly through chamber 112 onto the wet ceramic slurry coated pattern assembly. A downwardly directed dust-confinement air curtain is formed at front opening 112*a* of chamber 112 by planar air streams discharged from air discharge nozzles 154 receiving compressed shop air from air manifold 152. Dust collection ducts 200 having vertical slot openings 200*a* are positioned on opposite sides of the chamber front opening 112*a* to collect any dust discharged from the chamber 112. The hopper 132 includes a plurality of elongated electrical cartridge heating elements 141 disposed on the side walls of the hopper 132 so to span across the hopper 132 and contact and heat the ceramic stucco particles SP therein to a superambient temperature described below. A thermocouple T is disposed in the hopper 132 to sense stucco temperature and provide feedback to a electrical power control C that controls electrical power supply PS connected to heating elements 141 to maintain a desired superambient stucco particulates temperature in the hopper 132. Suitable heating elements are available from Gaumer Co. Inc., 13616 Hempstead Highway, Houston, Tex.

Figure 3:
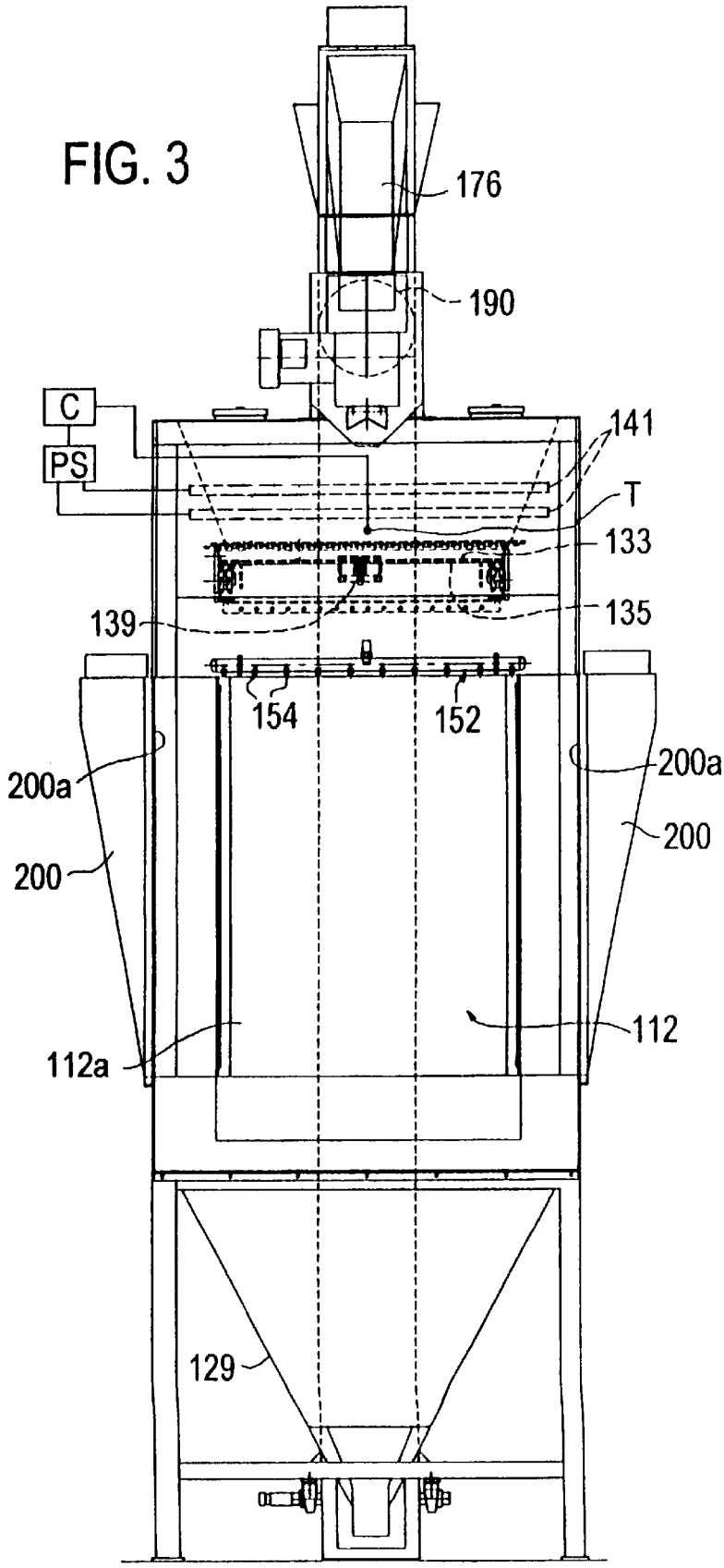
FIG. 3 is a front elevational view of the stucco tower of FIG. 2.

The hopper 132 includes fixed apertured (slotted) plate 133 and a movable apertured (slotted) plate 135 that is moved by actuator 139 to align the plate apertures in a manner to allow heated stucco particulates to be discharged at a controlled rate from the hopper downwardly through the chamber 112 as described in copending application Ser. No. 09/626,496. Ceramic stucco particles hitting the wet ceramic slurry coated pattern assembly form a stucco layer on adhering on the ceramic slurry layer. Ceramic stucco particles that do not hit or stick to the wet ceramic slurry on the slurry coated pattern assembly fall into a stucco collector 129 at the bottom opening of the chamber 112. A pick-up elevator 170 is provided with buckets 171 on endless chain 172 to return the collected stucco particles via a chute 176 and a drum separator 190 to the hopper 132 as described with respect to FIGS. 3 and 4 in the above copending application. Drum separator is rotated by electric motor 194.

Pursuant to an embodiment of the invention, the ceramic sand or stucco particulates are heated while residing in the hopper 132 by heating elements 141 to a superambient temperature; e.g. to a temperature in the range of about 90 degrees F. and 200 degrees F., preferably in the range of 120 to 180 degrees F., controlled to plus or minus 5 degrees F. for a shell being applied over a wax pattern, prior to application onto the wet facecoat slurry coating. Applying heated ceramic sand or stucco pursuant to the invention provides additional heat to accelerate drying and reduce drying time of the wet facecoat slurry layer and reduces pattern cooling from evaporative cooling, thus reducing temperature fluctuations of the wax pattern and stresses on the ceramic layer during the slurry/stuccoing step of shell mold building process.

The heated ceramic sand or stucco also can be applied by the well known approach of fluidizing the sand or stucco in a fluidized bed and immersing the slurry coated and drained pattern in the fluidized sand or stucco. Heated gas, such as dry air or nitrogen, can be used to heat the sand or stucco to the appropriate temperature, with a switch to ambient temperature fluidizing gas prior to immersion of the pattern in the fluidized sand or stucco.

The wet ceramic facecoat slurry with ceramic sand particulates thereon is dried initially for a time using relatively low humidity flowing air at an air dry bulb temperature above the thermal degradation temperature of the pattern (e.g. about 80 degrees F. for a wax pattern) and then subsequently for a time using relatively low humidity flowing air at an air dry bulb temperature below the pattern thermal degradation temperature (e.g. not exceeding about 78 degrees F.). The thermal degradation temperature is the temperature at which the pattern begins to melt, soften or otherwise distort from its desired shape.

For example, for a wax pattern assembly, the ceramic facecoat slurry with ceramic sand particulates thereon is dried initially for a time using flowing air at an air temperature in the range of 85 to 90 degrees F. followed by subsequent drying for a time using flowing air at a lower air temperature in the range 75 to 78 degrees F. The drying air typically is flowed at greater than about 200 feet/minute (e.g. 250 feet/minute), and relative humidity of about 1 to 10% (e.g. 10% relative humidity). The slurry coated/sanded pattern assemblies are dried initially at an air dry bulb temperature in the range of 85 to 90 degrees F. in a first drying room R1 and then dried at the lower air dry bulb temperature in the range of 75 to 78 degrees F. in a second drying room R2, FIG. 1.

Referring to FIG. 1, the robotic arm 90 can be extended through an opening OP in drying room R2 to hang each slurry coated/sanded pattern assembly 10 (illustrated schematically as dashed circles in FIG. 1) on a conventional powered and free linearly moving, indexable overhead conveyor 200, FIGS. 1A, 1B that carries the assemblies 10 through room R1 and then room R2. For example, each mold handle 14 includes a hook 14*a* that is hooked on a mold carrier 210 connected to the conveyor 200. Room R1 is a six-walled room within the larger room R2. Room R1 is separated from room R2 by sliding environmental control doors D1, D2 that open to allow the assemblies 10 to pass through and have appropriate openings through which the conveyor can pass into and out of the room R1.

Room R1 includes an air supply duct 201 having a louvered outlet opening 202 with blower or fan 203 on an inner vertical side wall of the duct 201 to direct heated drying air to flow laterally (e.g horizontally) as illustrated by arrows toward the assemblies 10 passing through the room R1 on conveyor 200. The heated drying air is discharged at the temperature, flow rate and relative humidity parameters set forth above. A conventional desiccant air conditioning system AC1 is provided to supply drying air with the desired temperature, flow rate and relative humidity to the duct 201. A return duct 204 having a return opening 205 on its vertical side wall is disposed in room R1 to receive and conduct spent drying air back to the air conditioning system AC1. After each slurry coated/sanded pattern assembly 10 is initially dried in room R1, it exits that room via opening of door D2 into larger room or tunnel R2 where it is dried at the lower air dry bulb temperature in the range of 75 to 78 degrees F. The room R2 includes a plurality of drying air outlets 302 on a common duct 301 disposed above and extending along the length of the conveyor 200. Each outlet 302 includes a respective blower or fan 303 to direct drying air downwardly as shown by arrows to flow pass the assemblies 10 and then to a common return duct 305, FIG. 1A, disposed below the conveyor 200 and extending along its length. A conventional desiccant air conditioning system AC2 is connected to supply duct 301 to supply conditioned air thereto and to the return duct to receive spent drying air. The conveyor indexes each assembly 10 to each drying air outlet 302 as it passes through the room R2 on its way to return to the robotic arm 90 along conveyor section CR.

After the pattern assembly is dipped in the facecoat slurry, drained, sanded and dried as described above pursuant to the invention, it is removed from the conveyor 200 and subjected to additional processing where additional primary and secondary back-up layers of slurry and sand or stucco are applied to build up the shell mold to a desired mold wall thickness. In particular, the robotic arm 90 dips the previously slurry coated/stuccoed pattern assembly 10 in one of the ceramic slurry pots P1, P5, P6, P7, at respective stations S1, S5, S6, and S7, drains excess slurry therefrom, and then applies ceramic stucco particles at stucco tower T1 or T2. The ceramic slurry pots P1, P5, P6, P7 typically have different ceramic slurries therein, while the stucco tower T1 at station S3 and T2 at station S4 typically have different types of ceramic stucco particles in their hoppers 32 so as to build up a shell mold with different layers of ceramic slurry and ceramic stucco particles appropriate to the metal casting operation to be conducted. Each layer of ceramic slurry and ceramic stucco particles is dried in room R1 and then in room R2 in the manner described above. A typical shell mold wall thickness is in the range of ⅛ to ½ inch, although other mold wall thicknesses can be built-up as desired for different casting applications. For example, 2nd through 8th back-up layers can be applied onto the $1^{st}$ facecoat slurry/sand layer. The composition and number of the back-up layers can be varied as desired for a particular shell mold casting application. An outermost cover layer comprising a ceramic slurry without sand or stucco can be applied to the outermost back-up layer to seal the shell mold.

The back-up layers and cover layer typically comprise different ceramic slurries and different sands or stuccoes from that used for the 1st facecoat slurry/sand layer as is well known. For example, the 1st facecoat ceramic slurry for casting nickel base superalloys can comprise a slurry having a fine alumina flour or powder in an amount of 75 weight % in a water based colloidal silica suspension with other conventional additives such as surfactants, organic green strength additives, and foam reduction additions, such additives being described, for example, in U.S. Pat. No. 5,975,188. The facecoat slurry can be sanded with fine fused alumina sand particles. Primary back-up layers (e.g. the 2nd and 3rd slurry/sand layers) applied proximate the 1st facecoat layer can comprise a relatively low viscosity water based slurry having colloidal silica with fused silica and zircon ceramic flour or powder, and slightly coarser fused silica sand. Additional secondary back-up layers (e.g. the 4th through 8th and the cover layer applied on the primary back-up layers can comprise a higher viscosity water based slurry having colloidal silica with fused silica and zircon ceramic flour or powder, and even coarser fused silica sand or stucco.

The additional back-up layers and cover layer are applied pursuant to the invention in the manner described above where each ceramic slurry is at a temperature in the range of about 72 degrees F. and 75 degrees F. plus or minus 1 degree F. for wax pattern. Each back-up layer is applied to the coated pattern first by dipping the coated pattern in the respective ceramic slurry, draining excess slurry and applying (gravity rainfall) onto the wet ceramic back-up slurry layer the ceramic sand or stucco particulates heated at a temperature in the range of about 90 degrees F. and 200 degrees F., preferably in the range of 90 to 180 degrees F. plus or minus 5 degrees F. Each ceramic back-up slurry layer and cover slurry layer with ceramic sand particulates thereon is dried initially for a time using relatively low humidity flowing air at an air temperature above the pattern thermal degradation temperature and then subsequently for a time using relatively low humidity flowing air at an air temperature below the pattern thermal degradation temperature. In particular, for a wax pattern assembly, initial drying occurs for a time using flowing air at an air temperature in the range of 85 to 90 degrees F. followed by subsequent drying for a time using flowing air at an air temperature in the range of 75 to 80 degrees F. The drying air is flowed at greater than about 200 feet per minute and relative humidity of about 1 to 10% as described above. Preferably, the 2nd through 4th back-layers are dried at an air temperature of 75–78 degrees F., while the 5th through 8th back-up layers and cover layer are dried at an air temperature of 75 to 80 degrees F. Typical parameter ranges for processing of wax patterns pursuant to the invention are shown in Table 1:

TABLE 1

| | |
|---|---|
| Pattern Material | WAX |
| Slurry Temperature | 72–75 ± 1° F. |
| Stucco Temperature | 90–180 ° F. ± 5° F. |
| Drying Humidity | Low, 1–10% |
| Air Flow | Higher and turbulent (>200 f/m) |

| Drying Procedure | Temperature I (° F.) | Time I (min) | Temperature II (° F.) | Time II (min) |
|---|---|---|---|---|
| 1st Dip | 85–90 | 10–25 | 75–78 | 20–45 |
| 2nd Dip | 85–90 | 10–25 | 75–78 | 20–45 |
| 3rd Dip | 85–90 | 10–25 | 75–78 | 20–45 |
| 4th Dip | 85–90 | 15–30 | 75–78 | 20–45 |
| 5th Dip | 85–90 | 15–30 | 75–80 | 20–45 |
| 8th Dip | 85–90 | 15–30 | 75–80 | 20–45 |
| 7th Dip | 85–90 | 15–30 | 75–80 | 20–45 |
| 8th Dip | 85–90 | 15–30 | 75–80 | 20–45 |
| Cover | 85–90 | 15–40 | 75–80 | 1 h–10 h |
| Total | | 2.75–5.0 hr | | 2.5–16 hr |

In Table 1 and other Tables below, temperature I and time I are the initial air dry bulb temperature and total drying time in room R1 and temperature II and time II are the air dry bulb temperature and total drying time in room R2. The term "f/m" is feet per minute. The term "rH" is relative humidity.

The following Examples are offered to further illustrate, but not limit, the invention.

Identical wax patterns having a thermal degradation temperature where they begin to melt, soften or distort of about 78 degrees F. were used for all examples. The patterns were injection molded to the shape of a gas turbine engine nozzle ring.

EXAMPLE 1

A pattern was dipped in a facecoat slurry comprised of a water-based colloidal silica suspension with alumina ceramic flour of −325 mesh size (i.e. less than 325 mesh U.S. standard screen system) in an amount of 72 weight % of the slurry having a Zahn #4 cup viscosity of 18 seconds. The facecoat slurry also contained less than 5 weight % cobalt-containing ceramic flour finer than 20 micron size and less than 2.5 weight % organic additions for improved wetting, increased green strength and foam reduction. The dipped pattern was drained by gravity of excess slurry and coated with fine sand (120 mesh fused alumina) that was heated as shown in Table 2. The sanded wet facecoat slurry was placed in a controlled temperature and humidity drying station and first dried in flowing air at a temperature of 86 degrees F. for 15 minutes and then in flowing air at a temperature of 75 degrees F. for 30 minutes as shown in Table 2. The flowing air was moving at a velocity of about 250 feet/minute with a relative humidity decreasing from approximately 15% immediately after drying began to less than 7% during the 15 minute initial drying stage. The flowing air relative humidity was less than 7% during the 30 minute secondary drying stage.

Primary back-up layers were applied to the facecoat slurry/sand layer without prewet slurries to speed processing. The coated pattern was dipped in a relatively low viscosity slurry of water-based colloidal silica with fused silica powder of −200 mesh size in an amount of 60 weight percent of the slurry. The primary backup slurry also contained less than 2 weight % organic additions for improved wetting, improved drainage, increased green strength and foam reduction. The slurry was used for the $2^{nd}$ and $3^{rd}$ back-up slurry layers with a Zahn #4 cup viscosity of 12 seconds. After draining excess slurry, the coated pattern was sprinkled with 90 mesh fused alumina that had been heated to 150 degrees F. for the second dip and with 28×48 mesh (i.e. stucco particle size less than 28 mesh and more than 48 mesh U.S. standard screen system) tabular alumina likewise heated to 150 degrees F. for the third dip. The sanded wet slurry dip layers were dried in environmentally controlled flowing air with velocity greater than 50 feet/minute for times and using parameters shown in Table 2 and as described above for the sanded wet facecoat slurry.

The secondary back-up layers ($4^{th}$ through $8^{th}$ back-up layer and cover layer) then were applied by dipping the coated pattern in a relatively higher viscosity slurry of water-based colloidal silica with fused silica powder of −200 mesh size in an amount of 66 weight percent of the slurry. The secondary back-up slurry also contained less than 2 weight % organic additions for improved wetting, improved drainage, increased green strength and foam reduction, and had a Zahn #4 cup viscosity of 19 seconds. After draining the excess slurry, each slurry dip was stuccoed with coarse sand (14×28 mesh Mulgrain 47) that had been heated to 150 degrees F. The slurry dip layers were dried in environmentally controlled flowing air with velocity greater than 250 feet/minute for times and using parameters shown in Table 2 and as described above for the sanded wet facecoat slurry. After the cover dip coat, final drying of the shell molds was similarly conducted as shown in Table 2.

TABLE 2

| | Sand/ Stucco Temperature (° F.) | Initial Drying Temperature/ Humidity (° F./rH) | Initial Drying Time (hr) | Secondary Drying Temperature/ Humidity (° F./rH) | Total Dip Drying Time (hr) |
|---|---|---|---|---|---|
| Facecoat | 150 | 86/10–15% | 0.25 | 75/<7% | 0.75 |
| 2nd Dip | 150 | 86/10–15% | 0.25 | 75/<7% | 0.75 |
| 3rd Dip | 150 | 86/10–15% | 0.25 | 75/<7% | 0.75 |
| 4th Dip | 150 | 86/10–15% | 0.25 | 75/<7% | 0.75 |
| 5th Dip | 150 | 86/10–15% | 0.25 | 75/<7% | 0.75 |
| 6th Dip | 150 | 86/10–15% | 0.25 | 75/<7% | 0.75 |
| 7th Dip | 150 | 86/10–15% | 0.25 | 75/<7% | 0.75 |
| 8th Dip | 150 | 86/10–15% | 0.25 | 75/<7% | 0.75 |
| Cover Dip | 150 | 86/10–15% | 0.25 | 75/<7% | 2 |
| | | | Total Process Time | | 8 |

The shell mold produced pursuant to Table 2 was subjected to a pattern removal operation involving steam autoclave removal of the wax pattern and then the resulting shell mold was heated to 1600 degrees F. in air for 2 hours to develop adequate mold strength for casting. After firing the mold was cut open and inspected for defects. No spall or crack defects were observed.

Standard Example 2

A pattern was dipped in the facecoat slurry used in Example 1, drained by gravity of excess slurry and coated with fine sand (120 mesh fused alumina) that was unheated at 72 degrees F. The sanded wet facecoat slurry was placed in a controlled temperature and humidity drying station and dried in static air at a temperature of 75 degrees F. for 3 hours as shown in Table 3. Primary back-up layers were applied to the facecoat slurry/sand layer as in Example 1, without prewet slurries to speed processing. The coated pattern was dipped in the Example 1 primary back-up slurry, and the coated pattern was sprinkled with 90 mesh fused alumina that was unheated at 72 degrees F. for the second dip and with 28×48 mesh tabular alumina likewise unheated for the third dip. The sanded wet slurry dip layers were dried in environmentally controlled, relatively static air for times and using parameters shown in Table 3.

The secondary back-up layers ($4^{th}$ through $8^{th}$ back-up layer and cover layer) then were applied by dipping the coated pattern in the relatively higher viscosity secondary back-up slurry of Example 1. After draining the excess slurry, each slurry dip was stuccoed with coarse sand (14×28 mesh Mulgrain 47) that was unheated at 72 degrees F. The slurry dip layers were dried in environmentally controlled flowing air with velocity greater than 100 feet/minute for times and using parameters shown in Table 3. After the cover dip coat, final drying of the shell molds was similarly conducted as shown in Table 3.

TABLE 3

| | Sand/ Stucco Temperature (° F.) | Initial Drying Temperature/ Humidity (° F./rH) | Initial Drying Time (hr) | Secondary Drying Temperature/ Humidity (° F./rH) | Total Dip Drying Time (hr) |
|---|---|---|---|---|---|
| Facecoat | 72 | N/A | N/A | 75/45% | 3 |
| 2nd Dip | 72 | N/A | N/A | 75/45% | 3 |
| 3rd Dip | 72 | N/A | N/A | 75/45% | 3 |
| 4th Dip | 72 | N/A | N/A | 75/30% | 2 |
| 5th Dip | 72 | N/A | N/A | 75/30% | 2 |
| 6th Dip | 72 | N/A | N/A | 75/30% | 2 |
| 7th Dip | 72 | N/A | N/A | 75/30% | 3 |
| 8th Dip | 72 | N/A | N/A | 75/30% | 2 |
| Cover Dip | 72 | N/A | N/A | 75/10% | 24 |
| | | | Total Process Time | | 43 |

The shell mold produced pursuant to Table 3 was subjected to an autoclave pattern removal operation and heating to 1600 degrees F. in air for 2 hours as in Example 1. After firing the mold was cut open and inspected for defects. No spall defects were observed; however, six small cracks were observed between airfoil segments which might have resulted in casting defects requiring rework finishing.

Counter Example 3

A pattern was dipped in the facecoat slurry used in Example 1, drained by gravity of excess slurry and coated with fine sand (120 mesh fused alumina) that was unheated at 72 degrees F. The sanded wet facecoat slurry was placed in a controlled temperature and humidity drying station and dried in static air at a temperature of 75 degrees F. for 45 minutes as shown in Table 4. Primary back-up layers were applied to the facecoat slurry/sand layer as in Example 1, without prewet slurries to speed processing. The coated pattern was dipped in the Example 1 primary back-up slurry, and the coated pattern was sprinkled with 90 mesh fused alumina that was unheated at 72 degrees F. for the second dip and with 28×48 mesh tabular alumina likewise unheated for the third dip. The sanded wet slurry dip layers were dried in environmentally controlled, relatively static air for times and using parameters shown in Table 4.

The secondary back-up layers ($4^{th}$ through $8^{th}$ back-up layer and cover layer) then were applied by dipping the coated pattern in the relatively higher viscosity secondary back-up slurry of Example 1. After draining the excess slurry, each slurry dip was stuccoed with coarse sand (14×28 mesh Mulgrain 47) that was unheated at 72 degrees F. The slurry dip layers were dried in environmentally controlled flowing air with velocity greater than 100 feet/minute for times and using parameters shown in Table 4. After the cover dip coat, final drying of the shell molds was similarly conducted as shown in Table 4.

TABLE 4

| | Sand/ Stucco Temperature (° F.) | Initial Drying Temperature/ Humidity (° F./rH) | Initial Drying Time (hr) | Secondary Drying Temperature/ Humidity (° F./rH) | Total Dip Drying Time (hr) |
|---|---|---|---|---|---|
| Facecoat | 72 | N/A | N/A | 75/45% | 0.75 |
| 2nd Dip | 72 | N/A | N/A | 75/45% | 0.75 |
| 3rd Dip | 72 | N/A | N/A | 75/45% | 0.75 |
| 4th Dip | 72 | N/A | N/A | 75/30% | 0.75 |
| 5th Dip | 72 | N/A | N/A | 75/30% | 0.75 |
| 6th Dip | 72 | N/A | N/A | 75/30% | 0.75 |
| 7th Dip | 72 | N/A | N/A | 75/30% | 0.75 |
| 8th Dip | 72 | N/A | N/A | 75/30% | 0.75 |
| Cover Dip | 72 | N/A | N/A | 75/10% | 2 |
| | | | Total Process Time | | 8 |

The shell mold produced pursuant to Table 4 was subjected to an autoclave pattern removal operation as in Example 1. Inspection after pattern removal showed possible defects and the mold was cut open and inspected for defects. Massive spallation defects were observed between all of the airfoil segments and large through cracks were observed in a number of locations. Thus the application of the invention in Example 1 resulted in successful mold production at greatly reduce times over the standard Example 2 which also produced a generally acceptable quality mold albeit with minor defects due to pattern temperature fluctuations during the shell mold building process and eliminated the defects that result from simply accelerating the standard process as shown in Example 3.

Example 1 illustrative of the invention produced a defect-free shell mold as compared to "standard" Example 2 representative of current shell mold build practice and as compared to "Counter" Example 3 representative of simplistic efforts to speed mold processing.

Although the invention has been described with respect to certain embodiments thereof, those skilled in the art will appreciate that the invention is not limited to these embodiments and changes, modifications, and the like can be made therein within the scope of the invention as set forth in the appended claims.

We claim:

1. A method of forming a ceramic investment shell mold on a fugitive pattern of an article, comprising:

applying a ceramic slurry on the pattern, applying ceramic particulates heated above ambient temperature on the ceramic slurry before drying said ceramic slurry while said ceramic slurry is wet, and drying the wet ceramic slurry with the ceramic particulates thereon.

2. The method of claim 1 including draining excess slurry between the slurry applying step and the particulates applying step.

3. The method of claim 1 including repeating the steps of applying and drying to build up a wall thickness of said shell mold on said pattern.

4. The method of claim 1 wherein said pattern comprises a wax material.

5. The method of claim 1 wherein said ceramic slurry comprises a water based slurry at a temperature in a range of about 70 degrees F. and about 75 degrees F.

6. The method of claim 1 wherein said ceramic particulates are at a temperature in the range of about 90 degrees F. to about 200 degrees F.

7. The method of claim 1 wherein said ceramic slurry with ceramic particulates thereon on a wax pattern is dried initially for a time using flowing air at an air temperature in the range of 85 to 90 degrees F.

8. The method of claim 7 wherein said ceramic slurry with ceramic particulates thereon on a wax pattern is dried subsequently for a time using flowing air at an air temperature in the range of 75 to 80 degrees F.

9. The method of claim 8 wherein said flowing air is flowed at a velocity greater than about 200 feet per minute and relative humidity of about 1 to 10%.

10. A method of forming a ceramic investment shell mold on a fugitive pattern of an article, comprising:

applying a ceramic slurry on the pattern, applying ceramic particulates heated above ambient temperature on the ceramic slurry, and drying the ceramic slurry with the ceramic particulates thereon using drying air having a relative humidity of about 1% to 10%.

* * * * *